United States Patent [19]

van Steden

[11] Patent Number: 4,644,774

[45] Date of Patent: Feb. 24, 1987

[54] APPARATUS FOR COOLING A WORK ROLL IN A ROLLING MILL FOR ROLLING METAL STRIP

[75] Inventor: Gerhard van Steden, Broek op Langendijk, Netherlands

[73] Assignee: Hoogovens Groep B.V., IJmuiden, Netherlands

[21] Appl. No.: 808,029

[22] Filed: Dec. 12, 1985

[30] Foreign Application Priority Data

Dec. 17, 1984 [NL] Netherlands ..... 8403821

[51] Int. Cl.[4] ..... B21B 27/10

[52] U.S. Cl. ..... 72/201; 72/236

[58] Field of Search ..... 72/200, 201, 202, 236; 266/113

[56] References Cited

U.S. PATENT DOCUMENTS 2,921,488 1/1960 Davis ..... 72/201 X

FOREIGN PATENT DOCUMENTS 41-22363 12/1966 Japan ..... 72/201
156505 9/1984 Japan ..... 72/201
900894 1/1982 U.S.S.R. ..... 72/201
980884 12/1982 U.S.S.R. ..... 72/201

*Primary Examiner*—E. Michael Combs
*Attorney, Agent, or Firm*—Stevens, Davis, Miller & Mosher

[57] ABSTRACT

Apparatus for cooling a work roll in a rolling mill for rolling metal strip, has a plurality of sprays arranged in closely spaced rows extending in the longitudinal direction of the work roll, the sprays spraying water onto the work roll surface in a manner such that the surface of contact of the cooling water of each spray on the work roll surface is oblong in shape and the longitudinal axes of the said surfaces of contact form an angle to a describing line of the work roll surface. At least some of the sprays in at least two consecutive rows in the peripheral direction of the work roll are arranged so that the longitudinal axes of the surfaces of contact of the sprays in a first such row form an acute angle $\alpha$ to a first describing line on the work roll surface, and the longitudinal axes of the contact surfaces of the sprays in the second such row form an obtuse angle $\beta$ to a second describing line, whereby the surfaces of contact form a herringbone pattern. This improves cooling, particularly removal of cooling water from the roll.

16 Claims, 4 Drawing Figures

APPARATUS FOR COOLING A WORK ROLL IN A ROLLING MILL FOR ROLLING METAL STRIP

BACKGROUND OF THE INVENTION

1. Field of the Invention

The invention relates to apparatus for cooling a work roll in a rolling mill for rolling metal strip. Such apparatus has sprays arranged in a row extending in the longitudinal direction of the work roll, which sprays are directed at the surface of the work roll and spray cooling water onto the work roll surface during cooling of the work roll.

The invention will be described in this specification especially in connection with the hot strip rolling of steel; however, the invention may also be used in the cold rolling of steel, and in the rolling of metals other than steel.

2. DESCRIPTION OF THE PRIOR ART

In hot strip rolling, the work rolls, i.e. the rolls which come directly into contact with the rolled material, become hot. The temperature of these work rolls must not become too high, however, because the increased temperature causes thermal deformation of the work rolls, thereby rendering the strip profile, i.e. the variation of thickness of the strip in the direction perpendicular to the strip length, unacceptable. Moreover, high temperature of the work rolls leads to rapid wear of the work roll. For these reasons, it is normal for the work rolls to be cooled by spraying apparatus.

U.S. Pat. No. 2,921,488 shows cooling sprays in single rows on each side of the roll, in which thin spray jets have their axes inclined to the roll surface and have contact lines on the roll surface which are very slightly inclined (at 4°) to the longitudinal axis of the roll, so that they substantially form a continuous line parallel to the roll axis. The aim is to direct and hold the cooling water in the roughly V-shaped zone adjacent the contact line of two adjacent rolls.

SU-A No. 471912 shows a row of sprays on each side of the roll. The contact surfaces of the spray jets are oblong and all inclined at 30° to the axis of the roll. Over most of the roll length, each adjacent pair of contact surfaces are mutually offset in the circumferential direction of the roll. The aim in this disclosure is more uniform cooling and use of less cooling water.

SU-A No. 995933 (see "Soviet Inventions Illustrated", Derwent Publications Ltd. No. 83-832211/48 M21 P51) shows a single row of sprays of which each contact area is at 70°–75° to the roll axis. To achieve sectional control of the thermal profile of the roll, the contact areas are oppositely inclined to the roll axis on the two sides of the central radial plane of the roll.

Arranging oblong contact surfaces of the jets at an angle to the axis, e.g. 30° as mentioned above, has been found of benefit.

One problem that can arise in cooling work rolls using apparatus known in practice, in the case of hot strip rolling and particularly at a high production rate, is that the work rolls cannot be cooled sufficiently, with the result that extra waiting time must be allowed between the rolling of two consecutive hot strips.

SUMMARY OF THE INVENTION

The object of the invention is to provide apparatus capable of improved cooling of work rolls, and in particular improved discharge of the cooling water from the rolls.

According to the invention there is provided apparatus for cooling a work roll in a rolling mill for rolling metal strip, comprising a plurality of sprays arranged in a row extending in the longitudinal direction of the work roll, the sprays being directed at the work roll surface and spraying cooling water onto the work roll surface during cooling of the work roll in a manner such that the surface of contact of the cooling water of each spray on the work roll surface is oblong in shape and the longitudinal axes of the said surfaces of contact form an angle to a describing line on the work roll surface. This apparatus is characterized in that there are a plurality of said rows of sprays closely spaced in the peripheral direction of the work roll and in that at least some of the sprays in at least two consecutive rows in the peripheral direction of the work roll are arranged so that the longitudinal axes of the surfaces of contact of the sprays in a first such row form an acute angle $\alpha$ to a first describing line on the work roll surface, and the longitudinal axes of the surfaces of contact of the sprays in the second such row form an obtuse angle $\beta$ to a second describing line on the work roll surface having the same direction as the first describing line, whereby the surfaces of contact form a herringbone pattern.

One advantage of this apparatus is that the cooling of the work rolls is considerably improved. One important feature of this is that the discharge of the cooling water in the lateral direction is greatly promoted by the herringbone pattern.

A describing line of the roll surface is a line parallel to the axis, which would generate the roll surface if rotated about the axis.

The inventive concept described above may be embodied in a number of useful variants, such as:

(1) use of the herringbone pattern only in a limited area on both sides of the centre of the work roll (i.e. both sides of the centre plane perpendicular to the roll axis), (2) use of the herringbone pattern only on the side of the roll at which the rolled material is discharged.

(3) use of the herringbone pattern, but not in all rows of sprays, on the side of the roll at which the rolled material is discharged.

(4) use of herringbone patterns running in opposed directions on the two sides of the centre of the work roll respectively.

However, it is preferred that the contact surfaces of all, or almost all, the sprays of the first row form the acute angle ($\alpha$) and that the contact surfaces of all, or almost all, the sprays of the subsequent row form an obtuse angle ($\beta$) with the respective describing lines on the work roll surface. In this case, therefore, the herringbone pattern is used for all the sprays in at least two adjacent rows, and the direction of the herringbone pattern on both sides of the centre of the work roll is the same. In this embodiment, the cooling water discharge has been found to be a maximum.

Preferably this herringbone pattern is applied to at least three adjacent rows of sprays, particularly on the side of the roll at which the rolled material is discharged.

The inventive concept described above includes cases where the angles $\alpha$ and $(180° - \beta)$ vary considerably. For practical reasons, it is preferred that the sum of the angles $\alpha$ and $\beta$ be approximately 180°. In this case the herringbone pattern is largely symmetrical.

In order to improve the cooling of the work rolls the number of sprays could conceivably be increased, in an attempt to apply more cooling water to the work roll surface, so that the spray cones interfere with each other before reaching the work roll surface. In contrast, however, it is preferred in the invention that the sprays are arranged so that the spray cones of the sprays do not touch each other in their trajectory between the sprays and the work roll surface. Since the contact surfaces are oblong, the shape of the spray of water is of course not conical, but the term "cone" is used for convenience.

More preferably, the sprays should be arranged so that there is an unsprayed area of the work roll surface on the one hand between the surfaces of contact of the sprays belonging to each row and on the other hand between the surfaces of contact of a row and those of the adjacent row. As a result of this, the cooling water discharge, firstly from between two adjacent sprays in a row to the transition between two rows, then from between the two rows in the lateral direction, is substantially improved.

The width-length ratio of the surface of contact of the sprays should preferably lie in the range 1:4 to 1:10 more preferably 1:5 to 1:9. In this case the surface of contact is on the one hand long enough to achieve good cooling water discharge with the herringbone pattern, but on the other hand is not so long that the number of rows of sprays spaced round the periphery of the work roll does not become too small.

The acute angle $\alpha$ mentioned above should preferably be in the range 30 to 60 degrees, more preferably 35 to 55 degrees. At an angle smaller than 30 degrees, there is a risk that the spray cones will intersect each other, whilst at an angle greater than 60 degrees, there is a risk that a strip will be cooled too little on the work roll in the event of failure of a spray.

In a preferred embodiment, the sprays are arranged at the short spacing of between 100 and 200 mm from the work roll surface, sprays being used with a cooling water capacity ranging from 0.5 to 10 $m^3$/hour, at a pressure of approximately 15 bars.

BRIEF INTRODUCTION OF THE DRAWINGS

A preferred embodiment of the invention will be described below by way of non-limitative example with reference to the drawings, in which.

DESCRIPTION OF THE PREFERRED EMBODIMENT

Figure 1:
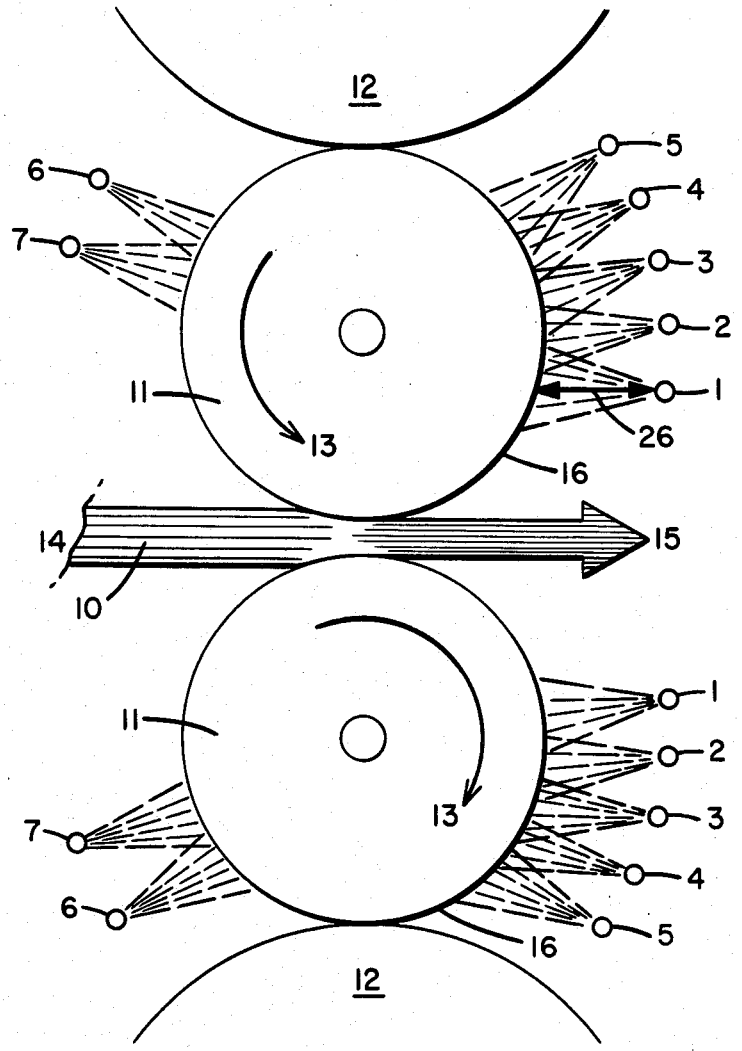
FIG. 1 shows diagrammatically apparatus for rolling metal strip in a vertical section, including cooling apparatus embodying the invention.

A steel strip 10 is rolled between two work rolls 11 as shown in FIG. 1. The work rolls 11 are generally supported by two backup rolls 12. The strip 10 passes through the rolling mill in the direction of rotation of the work rolls 11, from inlet side 14 to outlet side 15, the direction being denoted by the arrow 13.

A number of rows of sprays on the steel strip outlet side 15 and inlet side 14 respectively are denoted by reference numerals 1 to 5 and 6 and 7 respectively. These sprays spray cooling water onto the work roll surface 16 in order to cool it. In practice a smaller number of rows of sprays than shown in FIG. 1 is generally used, for example three on the outlet side and one on the inlet side.

Figure 2:
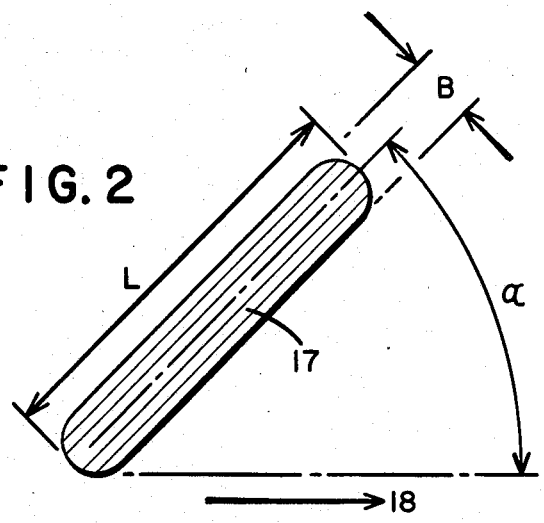
FIG. 2 shows the surface of contact on the surface of the work roll of a spray of the apparatus of FIG. 1 for cooling the work roll.

FIG. 2 shows the surface of contact 17 of the water sprayed from one of these sprays onto the surface 16 of the work roll 11. The sprays are of a type which gives an oblong surface of contact with a length L and width B, and the longitudinal axis of the surface of contact forms an acute angle $\alpha$ with the direction 18 of a describing line of the work roll surface 16, as a result of twisting of the spray from the line of the row.

Figure 3:
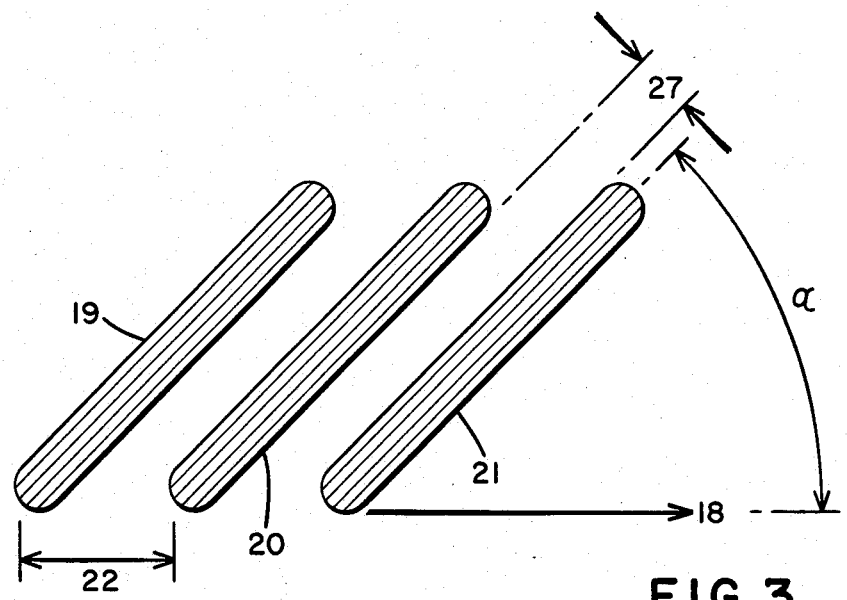
FIG. 3 shows the pattern of the surfaces of contact of a few adjacent sprays in a row of sprays forming part of the apparatus of FIG. 1 for cooling the work roll.

FIG. 3 shows the pattern of the surfaces of contact 19,20 and 21 of several adjacent sprays from one row. These contact surfaces are in a row with a spacing 22 between them and, as stated, form an angle $\alpha$ to the direction 18 of the describing line of the work roll surface. It is seen that there is an unsprayed area 27 of the work roll surface between the surfaces of contact 19,20 and 21 of the adjacent sprays of the row.

Figure 4:
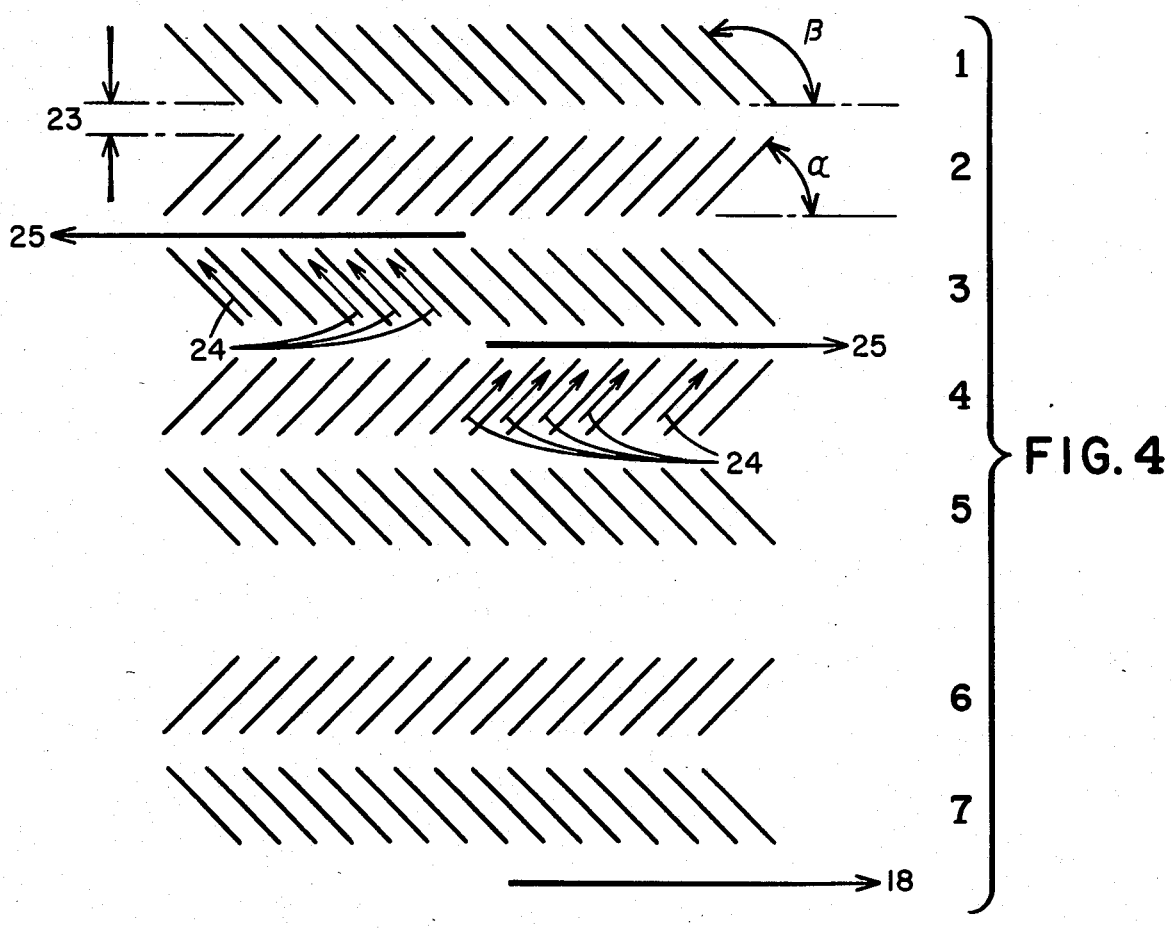
FIG. 4 shows the herringbone pattern of the surfaces of contact of the sprays of the apparatus of FIG. 1 for cooling a work roll according to the invention.

FIG. 4 shows the herringbone pattern of the surfaces of contact obtained when, according to the invention, at least a proportion of the sprays in at least two consecutive rows (in FIG. 4, the sprays in all the rows indicated in FIG. 1, i.e. 1 to 5 and 6 and 7) are arranged so that in a first row (in FIG. 4: e.g. row 2) the surfaces of contact form an acute angle $\alpha$ to direction 18 of the describing line, whilst the surfaces of contact in a second row (in FIG. 4: e.g. row 1) form an obtuse angle $\beta$ with a describing line having the same direction 18. The same applies for each adjacent pair of the rows 1 to 5 and to the pair 6 and 7.

FIG. 4 shows a situation where the angles $\alpha$ and $(180°-\beta)$ are approximately the same, and where the angle $\alpha$ is approximately 45°.

There is an unsprayed section 23 between the surfaces of contact of each pair of consecutive rows (e.g. rows 1 and 2 in FIG. 4). The cooling water sprayed on to the work roll surface is discharged from between the surfaces of contact of a row, according to the arrows 24 shown in FIG. 4, then from between the rows according to the arrows 25 indicated in FIG. 4.

FIG. 1 also shows that the sprays, particularly on the outlet side 15, are mounted at a short spacing 26, between 100 and 200 mm, from the work surface.

What is claimed is:

1. Apparatus for cooling a work roll in a rolling mill for rolling metal strip, comprising a plurality of spray means arranged in a plurality of rows closely spaced in the peripheral direction of the work roll and extending in the longitudinal direction of the work roll, said spray means being directed toward the work roll surface and being arranged to spray cooling water onto the work roll surface during cooling of the work roll in a manner which defines a surface of contact of the cooling water from each spray means on the work roll surface which is oblong in shape and the longitudinal axes of the said surfaces of contact form an angle to a describing line on the work roll surface, at least a first row of said spray means being arranged so that the longitudinal axes of the surfaces of contact from said first row of said spray means form a first angle $\alpha$ to a first describing line on the work roll surface to direct removal of the cooling water towards one end of the work roll, and an adjacent second row of said spray means being arranged so that the longitudinal axes of the surfaces of contact from said adjacent second row of said spray means form a second angle $\beta$ to a second describing line on the work roll surface to direct removal of the cooling water towards the other end of the work roll, said surfaces of contact from adjacent rows forming a herringbone pattern.

2. Apparatus according to claim 1 wherein the surfaces of contact from all said spray means in said first row form an acute angle $\alpha$ with said first describing line and the surfaces of contact from all said spray means in said second adjacent row form an obtuse angle $\beta$ with said second describing line on the work roll surface.

3. Apparatus according to claim 1 wherein the sum of the angles $\alpha$ and $\beta$ is 180°.

4. Apparatus according to claim 1 wherein said spray means are arranged to deliver spray cones of cooling water which do not touch each other in their trajectory between spray means and the work roll surface.

5. Apparatus according to claim 4 wherein said spray means in each row provide a row of spaced surfaces of contact on the work roll surface and a peripheral space free of overlap between rows on said work roll surface.

6. Apparatus according to claim 1 wherein the width-length ratio of the surface of contact of each spray is in the range 1:4 to 1:10.

7. Apparatus according to claim 6 wherein the width-length ratio of the surface of contact of each spray is in the range 1:5 to 1:9.

8. Apparatus according to claim 1 wherein said angle $\alpha$ is in the range 30 to 60 degrees.

9. Apparatus according to claim 8, wherein said angle $\alpha$ is in the range 35 to 55 degrees.

10. Apparatus according to claim 1 wherein said spray means are spaced at a distance between 100 and 200 mm from the work roll surface, said spray means having a cooling water capacity in the range 0.1 to 10 $m^3$/hour at a working pressure of approximately 15 bars.

11. Apparatus according to clims 1 wherein there are at least three of said closely spaced rows of said spray means, with the angles of their contact surface axes to the respective describing lines alternating between $\alpha$ and $\beta$ in the peripheral direction of the roll to form said herringbone pattern.

12. Apparatus according to claim 2 wherein the sum of the angles $\alpha$ and $\beta$ is 180° C.

13. Apparatus according to claim 2 wherein said spray means spaced at a distance between 100 and 200 mm from the work roll surface, said spray means having a cooling water capacity in the range 0.1 to 10 $m^3$/hour at a working pressure of approximately 15 bars.

14. Apparatus according to claim 6 wherein said spray means spaced at a distance between 100 and 200 mm from the work roll surface, said spray means having a cooling water capacity in the range 0.1 to 10 $m^3$/hour at a working pressure of approximately 15 bars.

15. Apparatus according to claim 2 wherein there are at least three of said closely spaced rows of said spray means, with the angles of their contact surface axes to the respective describing lines alternating between $\alpha$ and $\beta$ in the peripheral direction of the roll to form said herringbone pattern.

16. Apparatus according to claim 6 wherein there are at least three of said closely spaced rows of said spray means, with the angles of their contact surface axes to the respective describing lines alternating between $\alpha$ and $\beta$ in the peripheral direction of the roll to form said herringbone pattern.

* * * * *